US005236190A

United States Patent [19]

Moss

[11] Patent Number: 5,236,190

[45] Date of Patent: Aug. 17, 1993

[54] BASKETBALL GRIP TRAINING DEVICE

[76] Inventor: Garry K. Moss, 245 W. Roosevelt Rd., #108-109, West Chicago, Ill. 60185

[21] Appl. No.: 660

[22] Filed: Jan. 5, 1993

[51] Int. Cl.[5] ..... A63B 69/00

[52] U.S. Cl. ..... 273/1.5 A; 472/56

[58] Field of Search ..... 273/1.5 A, 26 C, 54 B, 273/187.5, 187.2; 2/161 A; 340/665, 666, 693, 691, 692, 568; 472/56

[56] References Cited

U.S. PATENT DOCUMENTS 1,845,735 2/1932 Adams ..... 472/56
3,413,000 11/1968 Alkonis ..... 273/54 B
3,496,573 2/1970 Kuchar et al. ..... 273/1.5 A
3,703,715 11/1972 McNally ..... 340/666 X
5,149,085 9/1992 Sanchez ..... 273/1.5 A

FOREIGN PATENT DOCUMENTS 1587191 4/1981 United Kingdom ..... 273/187.5

*Primary Examiner*—Paul E. Shapiro
*Attorney, Agent, or Firm*—Douglas B. White

[57] ABSTRACT

A basketball grip training device attaches to a hand of a player by a releasable strap. A pressure sensitive alarm device is positioned on the strap to be located on the palm of the player's hand, and includes a pressure sensitive switch, a battery power source, and an encased electronic alarm coupled to the switch to provide an audible signal in response to actuation of said switch.

3 Claims, 2 Drawing Sheets

BASKETBALL GRIP TRAINING DEVICE

BACKGROUND OF THE INVENTION

1. Field of the Invention

The present invention relates generally to sports training devices and especially to devices and apparatus for teaching proper grip. More particularly this invention relates to a device for assisting an individual in learning the proper grip for "shooting" a basketball.

2. Description of the Prior Art

Previously no device has been developed for teaching the proper technique for gripping a basketball when engaged in the act of shooting, particularly for the jump shot. The tendency of many individuals is to hold the ball against their palm in addition to their finger tips, and in doing so they lose much control over the shot. The device of the present invention employs a pressure sensitive circuit to sense the contact of the ball against the palm and then to alert the player, thereby assisting the individual in learning finger tip control.

SUMMARY OF THE INVENTION

The present invention includes a pressure sensitive circuit which attaches to the palm of a player. This switch senses the contact of the ball and operates an audible alarm to alert the player of improper technique.

The device uses a releasable strap for attachment to the hand of a player and a pressure sensitive alarm device attached to the strap to be located on the palm of the player's hand. The alarm device includes a pressure sensitive switch, an electric battery power source, and electronic means coupled to said switch and said power source for providing an audible signal in response to actuation of said switch. The switch includes a spring contact positioned on the top of an encased piezoelectric alarm to complete the power circuit to the alarm.

While the invention will be described in connection with a preferred embodiment, it will be understood that it is not the intent to limit the invention to that embodiment. On the contrary, it is the intent to cover all alternatives, modifications, and equivalents as may be included within the spirit and scope of the invention as defined by the appended claims.

DESCRIPTION OF THE PREFERRED EMBODIMENT

Figure 1:
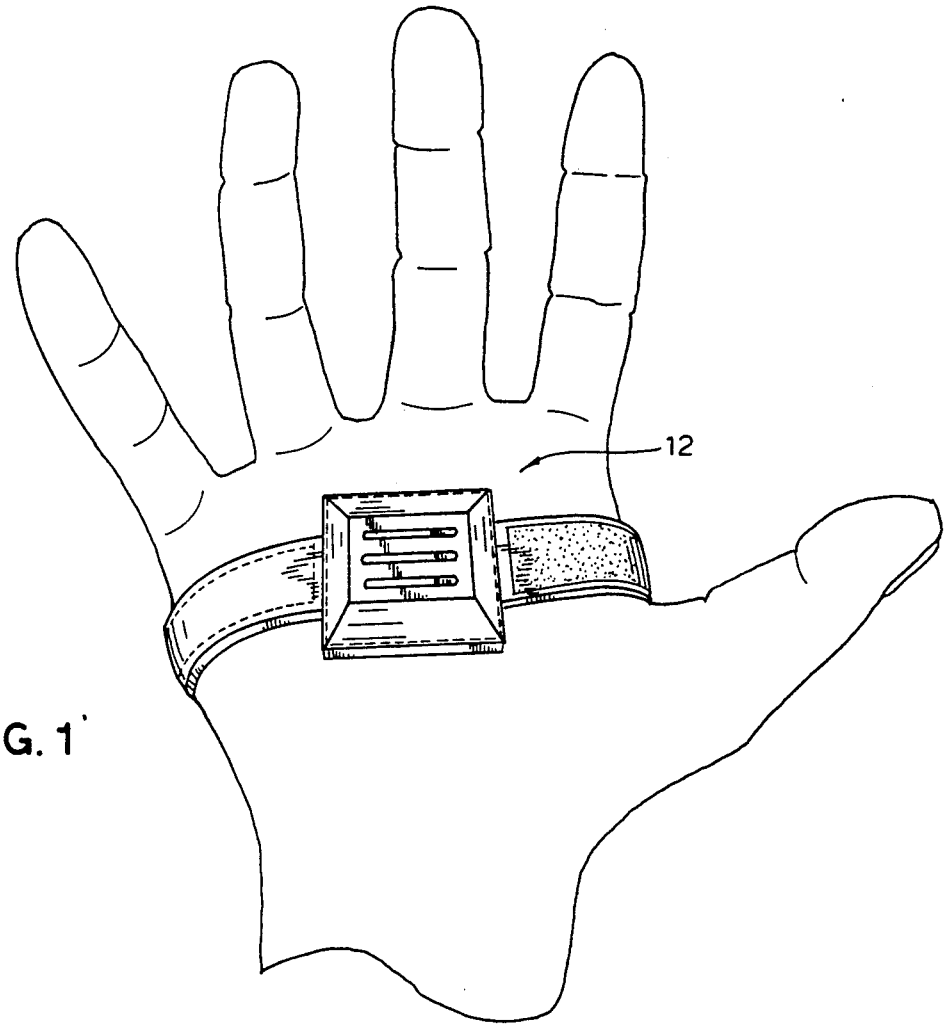
FIG. 1 is a pictorial view of the basketball training device of the present invention strapped to a players hand.

Turning to the drawings, there is shown in FIG. 1 a pictorial view of the basketball grip training device 12 of the present invention. This device attaches to the palm of a player's hand, as shown, to generate an alarm when pressure is applied thereto. When the player is "shooting", using proper technique, the basketball is held on the finger tips and no alarm will sound. But when the ball is allowed to touch the palm of the player's hand, the alarm will sound.

Figure 2:
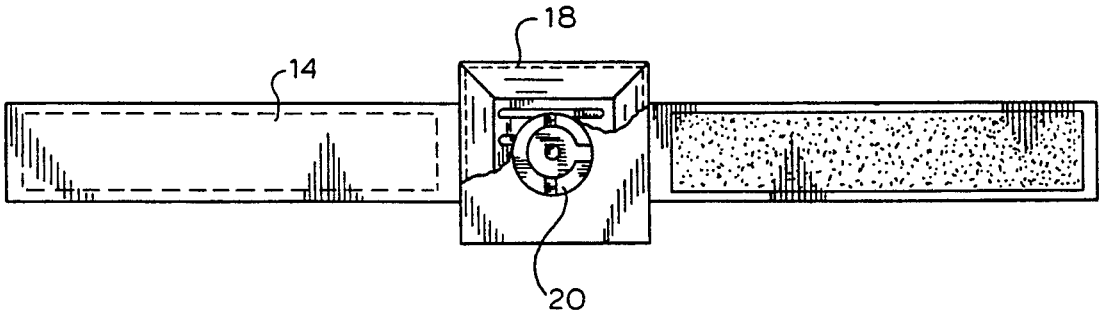
FIG. 2 is a partially cutaway view of the device of FIG. 1 removed from the players hand.

As shown in FIG. 2, this device is fastened to the hand with a strap 14 utilizing a releasable fastener, such as a hook/loop material (Velcro). The body of the device includes a flexible top surface 18 having a spring biased switch 20 thereunder arranged to connect battery power to an electronic alarm. The switch operated alarm in the preferred embodiment is a commerically available encased piezoelectric alarm (Murata Erie #PKB 24 spc-3601) which uses an oscillator circuit and a piezoelectric element to create the audible alarm.

Figure 3:
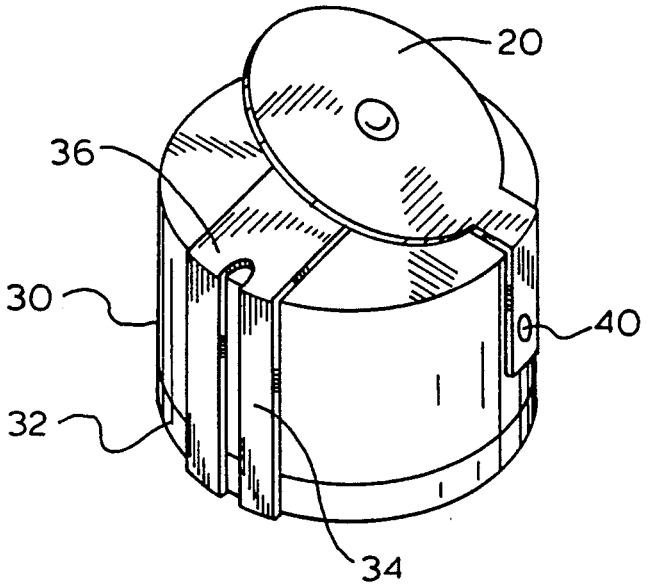
FIG. 3 is a pictorial view of the internal components of the device of FIG. 1.

The internal components and circuitry of the device of the present invention are shown in FIG. 3. The encased electronic alarm 30 and battery 32 are held together by a clamp 34. This clamp is an electric conductor which connects to the positive side of the battery and forms a contact 36 at the top of the alarm case. A spring biased contact 20 is mounted to the side of the alarm case and connects to the positive terminal 40 of the alarm. The negative connection for the alarm is on the underside of the alarm case and makes a direct contact to the negative side of the battery.

Pressure on the spring biased contact 20 (when the basketball touches the device) causes it to contact the clamp contact 36 and thereby complete the power circuitry to the alarm 30. When pressure on the spring biased contact is relieved, the power circuit to the alarm is opened, thereby terminating the sound.

From the foregoing description, it will be apparent that modifications can be made to the apparatus and method for using same without departing from the teachings of the present invention. Accordingly, the scope of the invention is only to be limited as necessitated by the accompanying claims.

I claim:

1. A basketball grip training device for attachment to a hand of a player comprising:

a releasable strap member for attachment to the hand of a player;

a pressure sensitive alarm device attached to said strap member and positioned thereon such as to be located on the palm of the player's hand, said alarm device including a pressure sensitive switch, a battery power source, and an encased electronic alarm having first and second power input terminals and coupled to said switch and to said power source for providing an audible signal in response to actuation of said switch;

wherein said pressure sensitive switch comprises a clamp member for securing said battery power source to the bottom of said electronic alarm case and providing electrical contact from a first terminal of said battery to the top of said electronic alarm case and causing electrical contact between said second terminal of said battery and a second power input terminal of said electronic alarm; and wherein said pressure sensitive switch further comprises a flexible resilient contact member hinged to said electronic alarm case proximate the top thereof and connected to a first power input terminal of said electronic alarm, said contact member being positioned for selective contact with said clamp member exposed at the top of said casing of said electronic alarm, whereby said flexible contact member makes contact with said clamp member, when actuated, to complete the power connection to said electronic alarm.

2. The basketball grip training device of claim 1 further comprising a flexible covering attached over said pressure sensitive switch.

3. The basketball grip training device of claim 2 wherein said releasable strap member includes hook/-loop fastening means.

* * * * *